United States Patent [19]

Vanhelle

[11] Patent Number: 4,495,760

[45] Date of Patent: Jan. 29, 1985

[54] PROCESS AND APPARATUS FOR SPINNING CORED FILAMENTS, AND CORED FILAMENTS THUS OBTAINED

[76] Inventor: Michel E. A. Vanhelle, 33, promenade Michel Simon, 93160 Noisy Le Grand, France

[21] Appl. No.: 385,676

[22] Filed: Jun. 7, 1982

[30] Foreign Application Priority Data

Jun. 12, 1981 [FR] France ..... 81 11642

[51] Int. Cl.[3] ..... D02G 3/38

[52] U.S. Cl. ..... 57/211; 57/6; 57/12

[58] Field of Search ..... 57/3, 6, 5, 12, 211, 57/334, 210, 225, 226, 236, 237, 14

[56] References Cited

U.S. PATENT DOCUMENTS

| | | | |
|---|---|---|---|
| 3,410,078 | 11/1968 | Freedman et al. | 57/211 |
| 3,921,382 | 11/1975 | Tsujita et al. | 57/6 |
| 4,069,656 | 1/1978 | Arai et al. | 57/6 |
| 4,351,146 | 9/1982 | Faure et al. | 57/12 X |

*Primary Examiner*—Donald Watkins

*Attorney, Agent, or Firm*—Darby & Darby

[57] ABSTRACT

Fiber sheaths are drawn between a pair of drawing cylinders and continuous filaments are introduced upstream of the drawing cylinders to form two strands which are twisted together at a convergence point upstream of a winding mechanism. The tension of the strands is regulated, the strands are wound to form a filament, and the filament thus formed is retwisted on a spinning jenny.

18 Claims, 4 Drawing Figures

PROCESS AND APPARATUS FOR SPINNING CORED FILAMENTS, AND CORED FILAMENTS THUS OBTAINED

The present invention has as its object a process and an apparatus for the spinning of cored filaments.

Cored filaments are known in which a core strand is enveloped by a sheath of discontinuous fibers. Processes to obtain cored filaments have been described, notably in U.S. Pat. Nos. 1,373,880, 2,024,156, 2,210,884, 2,313,058, 2,504,523, 2,526,523, 3,017,740 and 3,038,295.

The production of cored filaments can be accomplished on numerous spinning systems commonly used for the fabrication of filaments from discontinuous fibers. However, and in particular with the ring-cursor system, the cored filaments generally present the drawback of being limited in speed of production to that of the machines employed, and thus to the system of winding utilized.

Auto-wound filaments are also known, obtained by the natural detorsion in one direction and the other of two strands having previously received alternate right and left torsion. A process for the fabrication of auto-wound filaments on an auto-torsion jenny, and various applications, are described for example in the British Pat. Nos. 1 015 291, 1 121 942 and 1 084 371.

Auto-wound cored filaments are familiar from the U.S. Pat No. 4,033,102.

An original mode of realization of auto-wound cored filaments is described in the French Pat. Nos. 79 18173 and 79 13995.

The advantage of this process is to require only unidirectional motions at constant speed. On the other hand, its great drawback is imposing sudden and significant variations of torsion, and thus of tension, on the filament, which limits the effectiveness of the process in the area of speed and production, and increases the risk of slipping of the sheath filaments with respect to the core.

This phenomenon is well known in texturing of a continuous filament, in which if one uses an air nozzle as winder, the yield of torsion varies enormously as a function of the regularity of tension, which, by adopting a tension regulator, can produce textured output.

The present invention has as its goal to enable obtaining cored filaments with an extremely high speed of production, obtained by suppression of tension variations inherent in systems of auto-wound cored filaments.

This goal is achieved by a process for the spinning of cored filaments, according to which at least one fiber cord is drawn between a point of introduction of this cord and a pair of drawing cylinders, upstream of which can be introduced a continuous filament, and, in accordance with the invention, the strand formed by the fiber cord and perhaps the continuous filament is wound with at least one strand formed by a continuous filament and perhaps a fiber cord, by means of a friction torsion mechanism, by introducing them at a single point of convergence upstream of the torsion mechanism, the tension of the strands is regulated before the winding by passing them, after the twisting mechanism, across a pair of delivery cylinders, and after winding, the filament thus formed by the strands is retwisted on a respinning jenny. Continuous cored filaments can be supplied under constant tension. The filament formed by the strands is retwisted on a classical respinning jenny, for example a ring-cursor or double torsion jenny, to give the definitive torsion.

Thus, according to the invention, one or more fiber cords are drawn separately between points of introduction and pairs of drawing cylinders, possibly continuous cored filaments are supplied under constant tension, they are introduced into the said cords upstream of the various drawing cylinders, and the strands formed are made to converge in a single point of a torsion mechanism, before winding of the entirety. The entity formed by the strands is then submitted to a respinning jenny to provide the definitive torsion.

This goal is also achieved by an apparatus for the spinning of cored filaments comprising at least one core filament, particularly a continuous filament, and at least one sheath of fibers surrounding the core filament, with the said apparatus comprising:

- means of realization of at least two strands, one of which is constituted by at least one fiber cord, and perhaps at least one continuous filament, and the second is constituted by at least one continuous filament, and perhaps at least one fiber cord,
- means of false torsion by friction of the strands,
- means of regulation of the tension of the strands situated downstream of the means of torsion,
- means of winding, and
- means of retwisting of the filament formed by the strands.

The invention and the advantages it entails will be better understood by means of the examples of realization given below, in an illustrative, but not limitative function, and which are illustrated by the appended diagram, in which.

Figures 1, 2:
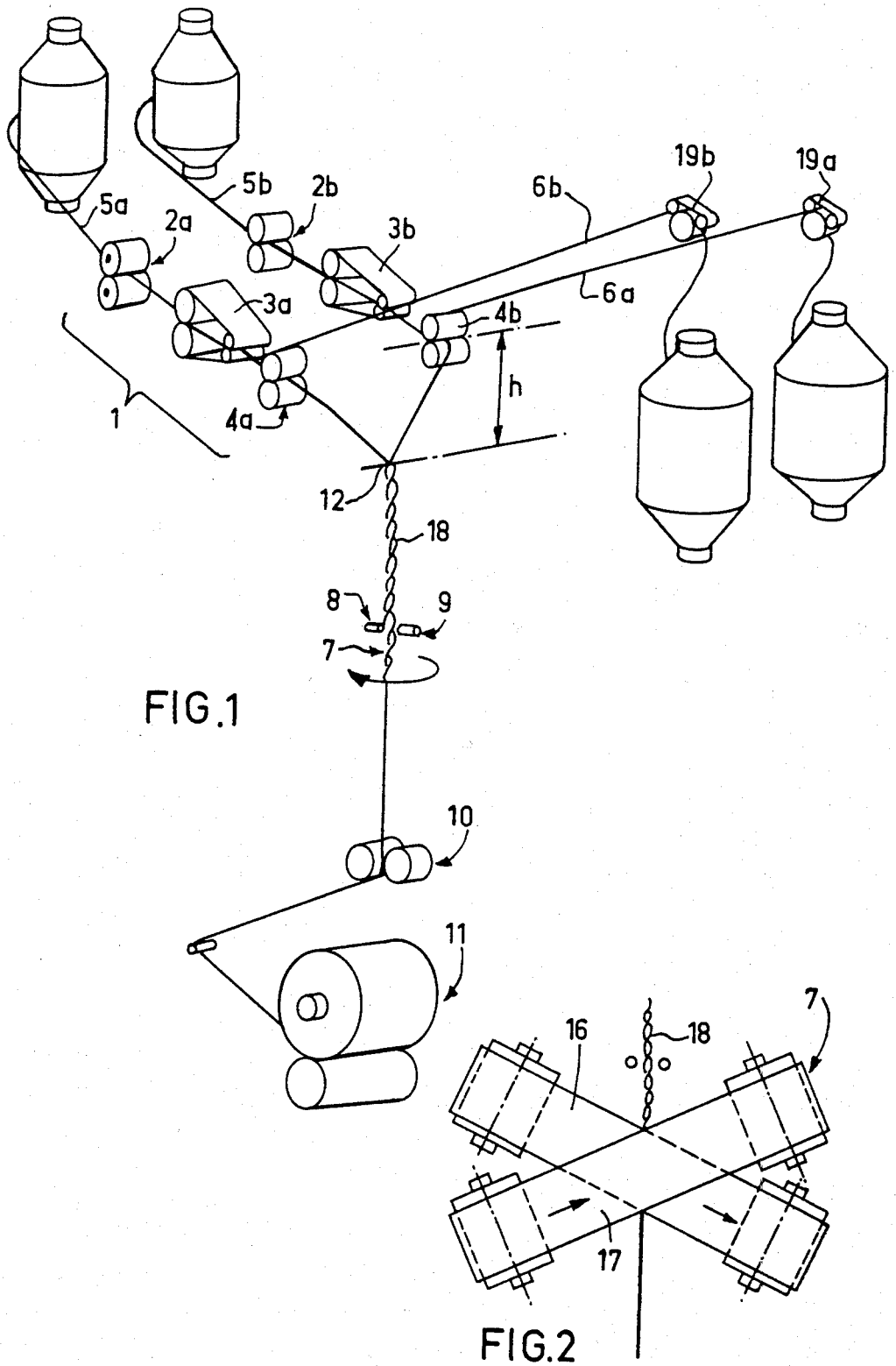
FIG. 1 is a schematic perspective view of an apparatus enabling obtaining a cored filament, double before entering into winding.
FIG. 2 is a front view of a type of winder used to impart false torsion.

According to the invention, a process of spinning is effected by drawing a cord of fibers 5*a* between a source point 2*a* and a pair of drawing cylinders 4*a*. The drawing system further includes a pair of drawing sleeves 3*a*. Parallel to this, a fiber cord 5*b* is separately drawn by a drawing system comprising a source point, namely a pair of supply cylinders 2*b*, a pair of drawing sleeves 3*b*, and a pair of drawing cylinders 4*b*.

Upstream of the drawing cylinders (4*a*, 4*b*) is introduced at least one continuous filament (6*a*, 6*b*). The tension of these filaments is regulated by tension regulating means 19*a*, 19*b*, for example cylinder and lash mechanisms 19*a*, 19*b*. Thus are formed two strands each constituted by a cord of fibers and a filament.

The strands thus formed are twisted together by a twister 7, and are guided by two guides 8 and 9. The two strands then pass over a pair of cylinders 10 before being wound on a cylinder 11.

It is important to regulate the tension between the drawers 4 and the supply cylinders 10, in order to have a suitable distance h between the drawers 4 and the point 12 of convergence of the filaments, in relation with the given torsion and the speed of spinning. In effect, there is a torsion in each of the simple strands formed by a cord of fibers and a continuous filament, between the point of convergence 12 of the strands and the point where the strand is ultimately seized by the drawers 4, but this torsion is not incorporated into the resulting filament. This torsion exists in the strands prior to convergence in an equilibrium magnitude, which depends on the geometry of the system and the parameters of spinning. The state of facts described above can, in practice, be modified. In fact, with irregularities occurring at random in the strands, a component of torsion is incorporated into the strands in a manner subject to random variation. Such a torsion, however, is low in intensity. As can be seen, the strands are wound on the cylinder 11. Then, in a subsequent stage, retwisting of the strands is performed, for example on a respinning jenny.

If the tension imparted by the twister 7 is too low, too little torsion is present in the strand beween the drawing cylinders 4 and the point of convergence 12, which results in losses of fibers at the outlet of the drawing cylinders 4, due to poor attachment of fibers onto the continuous filament. For example, excellent results have been obtained at the speed of 300 meters per minute with a tension beween the drawers 4 and the supply 10 equal to 1.53%, and a 2×25 Tex filament composed of a continuous filament core of 50 decitex and a sheath of wool fibers of 22.5 microns. Thus, the difference of speed between the drawing cylinders 4 and the supply cylinders 10 is regulated as a function of the spinning parameter and the speed of displacement. If the tension is too great, on the other hand, the core filament is excessively stretched, which entails a risk of slipping of the sheath fibers at the slightest rubbing.

After the twister 7, there is no overall torsion, that is, there is no auto-torsion. However, there remains a slight residual torsion in each of the two strands. This very small residual torsion is in fact randomly slightly to the right and slightly to the left, and due to the irregularities mentioned previously, with the result that the torsion existing between the drawing cylinders 4 and the point of convergence 12 is unidirectional, but with a variable amount of torsion.

However, it has been found that this alternating residual torsion is sufficient to ensure cohesion without having slipping of the fibers of the sheath with respect to the core, which permits the filament to be retwisted on a classical respinning jenny. For example, good results have been obtained with the 2×25 Tex filament previously described, on a double torsion jenny with a spindle speed of 11,000 turns per minute, and a torsion of 350 turns per meter, corresponding to a propagation of 62.8 meters per minute.

Figure 3:
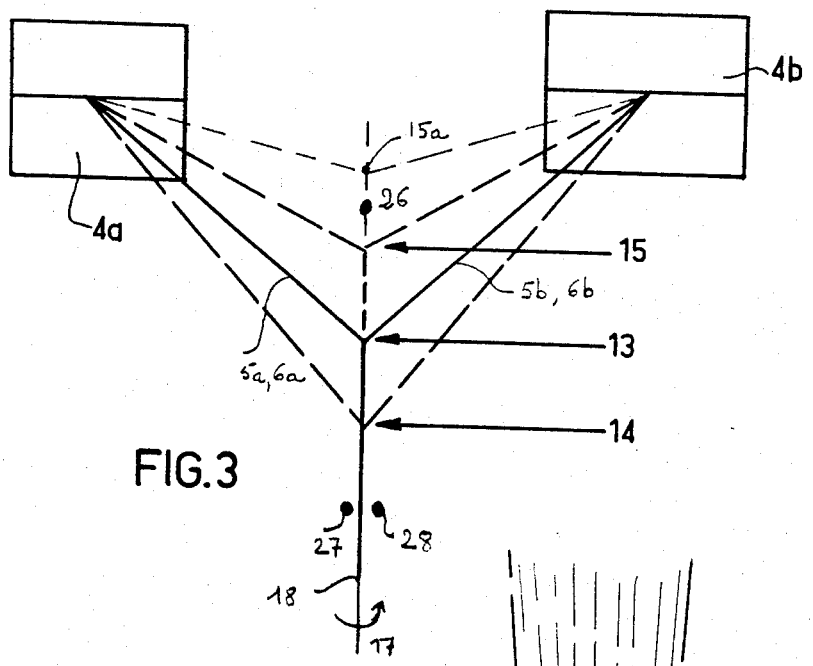
FIG. 3 is a schematic view of the position of the point of convergence.

The joining of the two strands before the twister 7 is important in the sense that it serves to regulate tension. In effect, as shown in FIG. 3 in which the position 13 of the point of convergence represents the means position, the position 14 corresponds to the point of convergence when there is a swelling in one of the two strands, when less torsion is transmitted by the twisting mechanism. The position 15 corresponds to the point of convergence when there is a fineness in the strand. The joining of the two strands is furthermore necessary according to the invention since the cohesion between the strands enables keeping the torsion alternating on each of the strands, which has the effect of avoiding the slipping of the fibers on the filament.

This phenomenon can also be utilized in advantageous fashion to detect the presence or absence of sheath filaments on the core by the variation of the point of convergence. In effect, if for any reason the covering of the fiber sheath comes to be missing, for example in the case of breakage of the fiber cord, the point of convergence 15 will rise very high, for example to the point 15*a*, whose position of course varies according to the regulation of the tension.

If, between the point 15 and the point 15*a* is placed a contact 26, on the axis joining the points of convergence 13, 14, 15, 15*a*, when the fiber of the fiber cord comes to be missing, the rise of the point of convergence 15 towards the point 15*a* trips the contact 26. This contact can thus be used to actuate various controls, for example controls of supply of fiber filament, or controls of raising of the receiver spool of the filament 11, or the stopping of the twister mechanism 7, etc.

Furthermore, the presence or absence of a strand formed either of a fiber cord alone, or a fiber cord and a continuous filament, is detected by the variation of the position of the filament 18 formed upstream of the twisting mechanism 7 (see FIG. 3).

In essence, two contacts 27, 28 placed one side and the other of the filament 18, are positioned upstream of the twisting mechanism 7. When a strand, for example 5*a*, 6*a* comes to be missing, the strand 5*b*, 6*b* takes a position 5'*b*, 6'*b* between the drawing cylinder 4*b* and the twisting mechanism 7. This position, which is displaced outward with respect to the line formed by the points 13, 14, 15, 15*a*, thus tends to displace the contact 28, which acts like the contact 15*a*. Symmetrically, when the strand 5*b*, 6*b* comes to be missing, the strand 5*a*, 6*a* is displaced towards the exterior with respect to the line of convergence points 13, 14, 15, 15*a*, and acts on the contact 27, which in turn acts on means of control enabling stopping of supply of filaments, of fibers, etc.

Thus, according to the invention is obtained a cored filament which presents no discontinuities such as knots, splices, or breaks, and which enables realization of spools of filament of significant weight, for example having a weight of at least 1 kg for fine filaments, for example of about 10 tex, and spools of filament of at least 10 kg for coarse filaments, for example for filaments of about 1000 tex.

Furthermore, FIG. 2 represents an example of a twister 7, which can be used, in a non-limitational sense, or as is indicated in French Pat. No. 1 147 515 (U.S. Pat. No. 2,943,433), it is envisioned to pass the filament to be twisted between two endless belts 16, 17, which are mobile, with these belts being arranged obliquely to one another so that an impulse is conferred on the filament which is in the direction of its displacement during its passage between the belts.

Between the drawing sleeves 3*a*, 3*b* and the drawing cylinders 4*a*, 4*b* are disposed a condensor 20, in itself familiar, which serves to condense the fibers on the continuous filament. Habitually, the filament is introduced into the center of the fiber cord, and then downstream of the drawing line 22, the strand receives the torsion which ensures the holding of the fibers to the filament. In the case of very high speed, it can result that the torsion is insufficient to ensure the holding of exterior fibers of the nap. A significant loss of fibers results.

Figure 4:
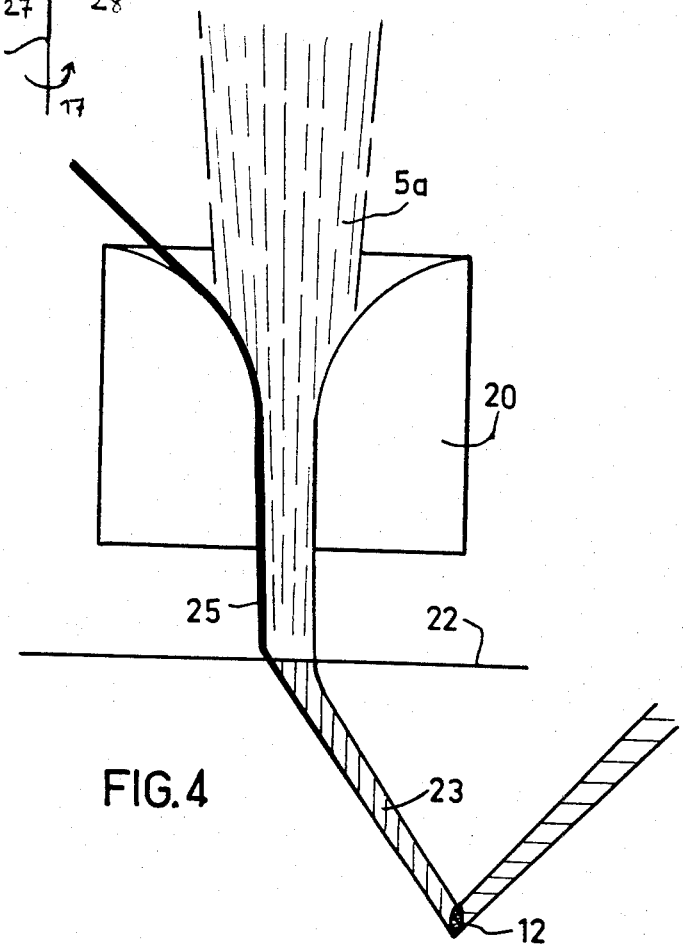
FIG. 4 is a large scale view of a condensor enabling condensing of the fibers on the continuous filament.

To remedy this drawback, it has been found that by introducing the filament 6 on the outside of the condensor 20, thus parallel to the generatrix 25 of the cylinder of revolution formed by the cord 5 and along this generatrix, the fibers are held perfectly. (See FIG. 4.) The generatrix 25 is situated to the side opposite the point of convergence 12 with respect to the cord or cords (5*a*, 5*b*).

A variant of the invention is such that it is possible to operate using a greater number of drawing systems than that described by FIG. 1.

Another variant, a significant one, is such that it is possible to work on one of the strands, with an assembly composed of a continuous filament and a sheath of fibers, while another strand consists of only a continuous filament. In this way a fiber sheath 5*b* is suppressed. For example, good results have been obtained at a speed of 200 meters per minute, with a filament of 71.5 tex resultant, composed of a core of 72 decitex and a fiber sheath on one of the strands, and a continuous filament of 72 decitex on the other strand.

A third variant is that it is possible to work on one of the strands, with an assembly composed of a continuous filament and a sheath of fibers, while another strand consists of only a fiber sheath, as long as there are sufficient fibers in section. Thus a continuous filament is suppressed, for example the filament 6*b*.

A fourth variant is that it is possible to work on one of the strands composed by a continuous filament, while the other strand consists of only a sheath of fibers, as long as there are sufficient fibers in section. There is thus a single continuous filament, for example the filament 6*a*, and a single fiber sheath, for example the fiber sheath 5*a*.

I claim:

1. A process for spinning a cored filament comprising the steps of drawing at least one fiber sheath between a point of introduction of the sheath and a pair of drawing cylinders, introducing at least one continuous filament upstream of said drawing cylinders to form at least two strands, twisting a strand comprising at least a fiber sheath with at least one other strand comprising at least a continuous filament, introducing the strands at a single convergence point upstream of a winding mechanism;

regulating the tension of the strands, winding the strands to form a filament, and retwisting the filament thus formed.

2. A process according to claim 1 wherein the tension of the strands before winding is regulated by passing them, after twisting, over a pair of delivery cylinders.

3. A process according to one of claims 1 and 2 wherein each filament is introduced into the fiber sheath before the twisting.

4. A process according to claim 1 wherein each filament is introduced along the generatrix situated opposite the point of convergence with respect to the sheath into which the filament is inserted.

5. A process according to claim 1 wherein each filament is introduced upstream of the drawing cylinders under constant tension.

6. A process according to claim 2 wherein the tension of the strands before winding is regulated by controlling the difference in speed between the delivery cylinders and the drawing cylinders.

7. A process according to claim 1 wherein the presence or absence of covering filaments on the core is detected by the variation of the position of the point of convergence.

8. A process according to claim 1 wherein the presence or absence of a strand is detected by the variation of the position of the filament formed upstream of said twisting.

9. Apparatus for carrying out the process of claim 1 comprising:

means for forming at least two strands, one of which comprises at least one cord of fibers and and at least one continuous filament and the second of which comprises at least one continuous filament;

means engageable with the strands for imparting a twist thereto;

means downstream of the twist means for regulating the tension of the strands;

means for winding the strands; and means for retwisting the strands.

10. Apparatus according to claim 9 wherein the strand forming means comprises a pair of supply rollers supplying a fiber cord, a pair of drawing sleeves for drawing the cord, a pair of drawing cylinders for drawing the cord, a cylinder and lash device regulating the tension of the continuous filament, a condensor situated between the drawing sleeves and the drawing cylinders; wherein the twist means comprises movable endless belts; wherein the tension regulating means comprises supply cylinders whose speed is regulated with respect to the speed of the drawing cylinders; and wherein the means for retwisting comprises a respinning jenny.

11. Apparatus according to claim 9 comprising at least two means for forming strands.

12. Apparatus according to claim 9 comprising a contact placed betrween the highest point of convergence in the presence of fibers and the point of convergence in the absence of fibers.

13. Apparatus according to claim 9 comprising two contacts situated on one side and the other of the filament, upstream of the twisting means.

14. Cored filament fabricated by the process of claim 1 characterized in that it presents no discontinuities and permits the realization of spools of filaments of at least 1 kg for fine filaments, of about 10 tex, and at least 10 kg for coarse filaments, of about 1000 tex.

15. Cored filament according to claim 14 characterized in that it comprises a first strand formed by a continuous filament and a cord of fibers, and a second strand formed by a continuous filament and a cord of fibers.

16. Cored filament according to claim 14 characterized in that it comprises a first strand formed by a continuous filament and a cord of fibers, and a second strand formed by a filament.

17. Cored filament according to claim 14 characterized in that it comprises a first strand formed by a cord of fibers, and a second strand formed by a continuous filament and a cord of fibers.

18. Cored filament according to claim 14 characterized in that it comprises a first strand formed by a cord of fibers, and a second strand formed by a continuous filament.

* * * * *